United States Patent [19]

Lee

[11] 3,958,470

[45] May 25, 1976

[54] DOUBLE ACTING RATCHET WRENCH WITH CAM ACTUATED OSCILLATORY PAWL

[76] Inventor: Bert Lee, 5010 Del Prado, Salt Lake City, Utah 84110

[22] Filed: June 26, 1975

[21] Appl. No.: 590,591

[52] U.S. Cl. ..... 81/63; 192/43.1

[51] Int. Cl.[2] ..... B25B 13/46

[58] Field of Search ..... 81/60–63.2; 192/43.1

[56] References Cited

UNITED STATES PATENTS

| | | | |
|---|---|---|---|
| 2,712,258 | 7/1955 | Keith | 81/63 |
| 3,255,647 | 6/1966 | Gray | 81/63.1 |
| 3,651,719 | 3/1972 | Wessel | 81/63.2 |

*Primary Examiner*—James L. Jones, Jr.
*Attorney, Agent, or Firm*—Warren F. B. Lindsley

[57] ABSTRACT

An improved double acting ratchet wrench employing a cam actuated positive drive oscillatory pawl which is engageable by a slight movement of the wrench handle and held tightly engaged by hand pressure on the handle.

8 Claims, 4 Drawing Figures

DOUBLE ACTING RATCHET WRENCH WITH CAM ACTUATED OSCILLATORY PAWL

BACKGROUND OF THE INVENTION

Heretofore double acting ratchet wrenches have been provided in which separate levers were used for arranging oscillatory movement around a ratchet wheel so as to impart to the wheel a uniform and continuous rotation through the medium of pawls on the levers. This kind of wrench is used for tightening and loosening nuts on bolts and the like. Most of these known ratchet wrenches employed a pawl which had to be moved manually independent of the movement of the handle of the wrench for causing directional movement of the associated ratchet wheel and associated shaft or socket and its frictional engagement of the pawl with the ratchet wheel was dependent on a spring biasing the pawl into engagement with the ratchet wheel.

SUMMARY OF THE INVENTION

A need exists, however, for an improved ratchet wrench which is simple to construct, economical in cost, reliable, durable and efficient in use.

It is, therefore, one object of this invention to provide a double acting ratchet wrench employing one handle which actuates a cam operable pawl into and out of engagement with a ratchet wheel.

Another object of this invention is to provide an improved double acting ratchet wrench in which movement of the wrench handle rotates a cam actuated pawl into engagement with the teeth of a ratchet wheel and pressure on the handle is transmitted through the teeth of the pawl against the teeth of the ratchet wheel.

A further object of this invention is to provide an improved double acting ratchet wrench in which oscillatory movement of the wrench handle causes oscillatory movement of a double tooth pawl into and out of engagement with a ratchet wheel.

A still further object of this invention is to provide an improved double acting ratchet wrench in which a single actuating lever or handle oscillates a double acting pawl by engagement of a cam on the handle with a cam surface on the pawl.

A still further object of this invention is to provide an improved double acting ratchet wrench in which the position of the actuating lever or handle of the wrench determines whether a pawl is in engagement with a ratchet wheel or nut.

A still further object of this invention is to provide an improved double acting ratchet wrench where the position of the handle determines the direction of rotation of a ratchet wheel and the amount of pressure of the pawl on the teeth of the ratchet wheel.

A still further object of this invention is to provide an improved ratchet wrench wherein the unattended position of the lever handle automatically disassociates the pawl means from the ratchet wheel.

Other objects and advantages of this invention will become apparent as the description proceeds and the features of novelty will be pointed out with particularly in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
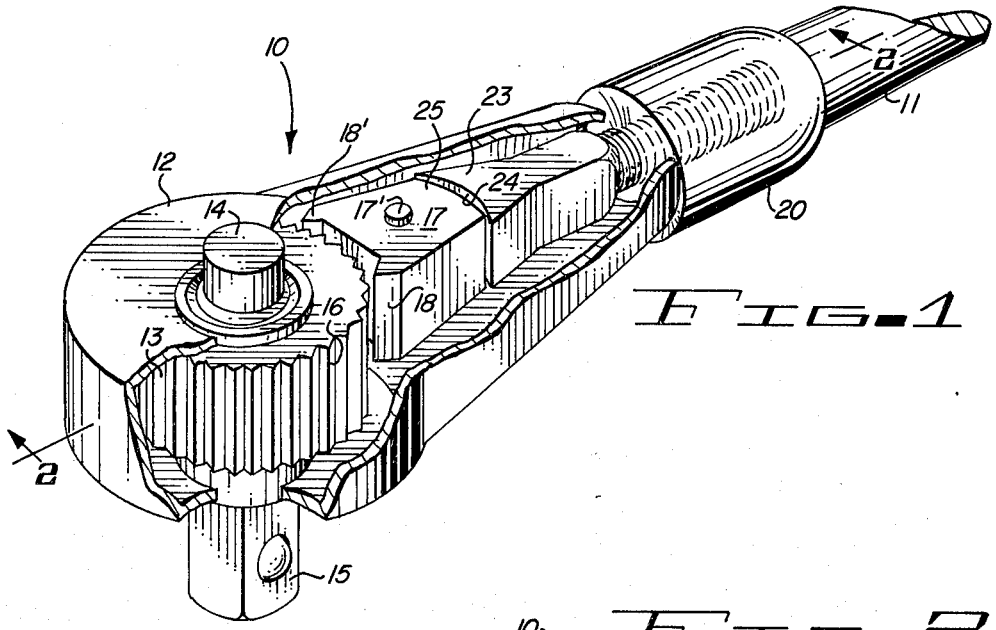
FIG. 1 is a perspective view partially broken away showing a ratchet wrench embodying the invention.
Figure 2:
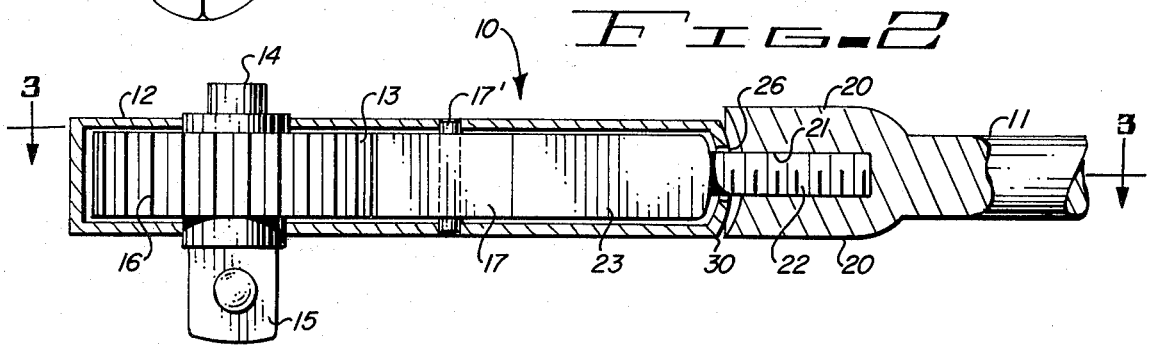
FIG. 2 is a cross-sectional view of FIG. 1 taken along the line 2—2.
Figure 3:
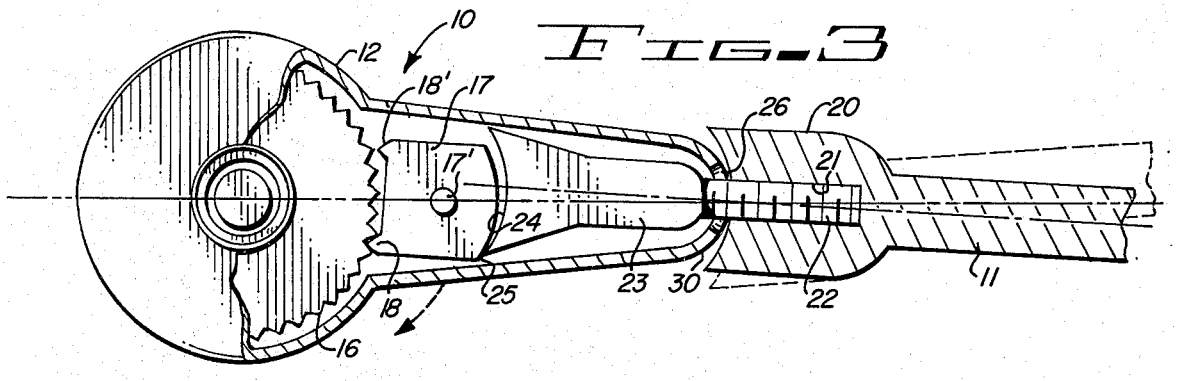
FIG. 3 is a cross-sectional view of FIG. 2 taken along line 3—3.

Referring more particularly to the drawing by characters of reference, FIGS. 1–3 disclose a double acting ratchet wrench 10 comprising a lever or handle 11 which is mounted to extend within a housing 12 which encloses a ratchet wheel 13, and its fixedly mounted shaft 14 is journaled for rotation therein. End 15 of shaft 14 is formed to fit a square, rectangular or polygonal opening of a nut socket for tightening or loosening nuts or other fastening devices. It should be recognized that this end of shaft 14 may be formed with a suitable opening, if so desired, to accommodate a nut to be rotated.

The ratchet wheel 13 is provided with a circumferential rack of gear teeth 16 completely around its periphery which are engageable by pawl means 17 which is pivotally mounted in housing 12 on a pin 17'. Pin 17' is parallelly arranged with shaft 14 of the ratchet wheel 13. Pawl means 17 has a pair of noses or dogs 18 and 18' at its opposite sides which re intended to engage the teeth of the ratchet wheel 13 upon predetermined movement of the handle 11 and acts to turn the ratchet wheel in one direction when the handle is moved in one direction or turn the ratchet wheel in a second direction when the handle is moved in a second direction.

As noted from the drawing, handle 11 comprises a collar 20 at one end thereof which is provided with a threaded aperture 21 extending into it a predetermined distance along the longitudinal axis of the handle for receiving the threaded shank of a bolt 22 which is fastened to an extension 23 of the handle mounted within the housing 12. The free end of the extension 23 if formed to provide an arcuate cam surface 24 which is intended to engage a cam 25 forming the end of pawl means 17 opposite to the end forming the dogs 18 and 18'.

Since the aperture 26 in the handle end of the housing 11 is large enough for bolt 22 within the handle 11 and its extension 23 within the housing may move relative to the housing with the sides of aperture 26 forming a pivot point.

Thus, a predetermined movement of the handle and the cam surface 24 on the end of extension 23 will cause the cam surface 24 to engage the cam 25 of the pawl means causing it to rotate about shaft 17' in a like direction. The rotation of pawl means 17 causes one of the dogs 18 or 18' at its end to engage the teeth 16 of ratchet wheel 13. It should be noted that the greater the turning pressure applied to the handle by the user of the ratchet wrench, the greater the engaging force between the dog on the pawl means and the teeth of the ratchet wheel.

In view of the cam surface 24 on the end of extension 23 of handle 11, when pivotal pressure on the handle has been released by the user, the handle moves back to its normal position extending with its longitudinal axis in line with a straight line through the axis of shaft 14 and pin 17'.

When handle 11 is pivoted about housing 11 in a direction opposite to that above described, the opposite dog on the pawl means engages with the teeth of the ratchet wheel.

Thus, in the usual manner of a ratchet wrench as the lever or handle 11 is turned in one direction, one of the dogs on the pawl means engages the teeth on the ratchet wheel to rotate the ratchet wheel in one direction and a plurality of turning movements from the handle's relaxed position will cause the dog on the pawl to slip over the engaged tooth of the ratchet wheel and engage the next tooth to rotate shaft 14 and ratchet wheel 13 in a given direction. As mentioned above, the opposite pivotal action of the handle will cause the opposite dog on the pawl means to engage the teeth on the ratchet wheel and rotate its shaft in the opposite direction.

It should be noted that the disclosed ratchet wrench eliminates the need for a spring means to bias the pawl means into any of its positions with extension 23 of handle 11 into any of its positions with extension 23 of handle 11 accomplishing that function. Further, handle 11 causing disengagement of the pawl means with the teeth of the ratchet wheel automatically by its movement back to its relaxed position. The movement back to its relaxed position also occurs automatically due to the shape of the cam suface 24 of extension 23 and also because the end of collar 20 is disc shaped so that its engagement with end 30 of housing 11 cuases it to move back to its relaxed position.

Figure 4:
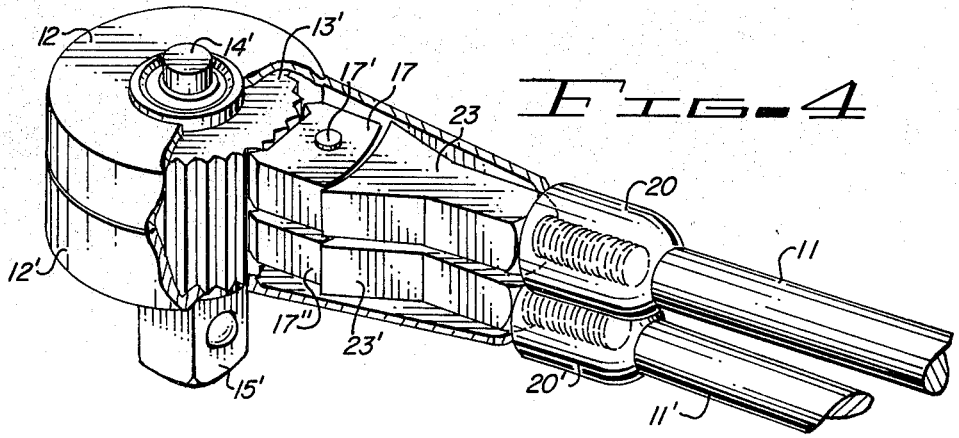
FIG. 4 is a modification of the ratchet wrench shown in FIGS. 1—3 employing two lever handles.

FIG. 4 illustrates a modification of the ratchet wrench shown in FIGS. 1—3 and differs therefrom by mounting two separate handles 11, 11', their associated extensions 23, 23', and pawl means 17, 17'' in two separate housings 12, 12'. The only difference from the wrench of FIGS. 1—3 is that a single ratchet wheel 13' and shaft 14' are used which extends into both housings 12, 12'.

Thus, FIG. 4 illustrates a duplex wrench comprising a holding unit and a turning unit with either unit being the holding unit and the other unit being the turning unit.

Although but two embodiments of the invention have been shown and described, it will be obvious to those skilled in the art that various changes and modifications may be made therein without departing from the spirit of the invention and the scope of the appended claims.

What is claimed is:

1. A ratchet wrench comprising:

a housing, a ratchet wheel rotatably mounted in said housing, pawl means pivotally mounted within said housing for oscillatory movement relative to said ratchet wheel, said pawl means having a pair of dogs spacedly mounted at one end thereof for selectively engaging teeth on the periphery of said ratchet wheel when rotated in a predetermined manner.

said pawl means forming a cam follower at its other end, a handle, one end of which is pivotally mounted in said housing to extend into said housing in close association with the cam follower of said pawl means, said one end of said handle being provided with a cam surface, said handle when pivoted about said housing causing said cam surface on its one end to engage the cam follower of said pawl means to rotate it about its pivotal connection to said housing causing a dog on its other end to engage a tooth of said ratchet wheel causing it to rotate a predetermined amount, whereby a release of pressure on said handle causes it to move back to a neutral position disengaging said dog on said pawl means for the teeth on said ratchet wheel.

2. The ratchet wrench set forth in claim 1 wherein:

said ratchet wheel is provided with a shaft extending out of said housing, the end of which is conformed to engaging a socket wrench.

3. The ratchet wrench set forth in claim 1 wherein:

said handle comprises an extension positioned within said housing one end of which is provided with a bolt wheich extends out of said housing for threaded engagement with a second part of said housing, and the free end of said extension is provided with said cam surface.

4. The ratchet wrench set forth in claim 1 wherein:

said cam surface of said handle comprises a dish shaped arcuate configuration.

5. The ratchet wrench set forth in claim 1 wherein:

said cam surface of said handle comprises a convex configuration and said cam follower of said pawl means comprises a concave configuration, said concave configuration of said cam follower pivotally moving within said convex configuration of the cam surface of said handle.

6. The ratchet wrench set forth in claim 5 wherein:

said cam follower engages the cam surface of said handle only at each end of its pivotal movement, thereby causing one of said dogs to engage the teeth of said ratchet wheel.

7. The ratchet wrench set forth in claim 2 wherein:

the axis of said shaft and the axis of pivotal movement of said pawl means are in parallel arrangement.

8. A ratchet wrench comprising:

a pair of separate housings juxtapositioned to each other, a ratchet wheel rotatably mounted in said housings, part of which extend into each of said housing, a pair of pawl means one pivotally mounted within each of said housings for oscillatory movement relative to said ratchet wheel, each of said pawl means having a pair of dogs spacedly mounted at one end of the pawl means for selectively engaging teeth on the periphery of said ratchet wheel when rotated in a predetermined manner, each of said pawl means having a surface at its other end forming a cam follower, a pair of handles one end of each being pivotally mounted in a different one of said housings in side by side arrangement and extending into the housing in close association with the cam follower of said pawl means in the housing, said one end of each of said handles being provided with a cam surface, each of said handles when pivoted about its housing causing its cam surface to engage the cam follower of the associated pawl means and rotating it about its pivotal connection to its housing causing a dog on its other end to engage a tooth of said ratchet wheel causing it to rotate a predetermined amount, whereby a release of pressure on the handle causes it to move back to a neutral position causing the dog on the associated pawl means to disengage the teeth on said ratchet wheel.

* * * * *